US008123113B1

(12) United States Patent
Hartman

(10) Patent No.: US 8,123,113 B1
(45) Date of Patent: Feb. 28, 2012

(54) SECURITY MAILBOX SYSTEM

(76) Inventor: Alfred Raymond Hartman, Hummelstown, PA (US)

( * ) Notice: Subject to any disclaimer, the term of this patent is extended or adjusted under 35 U.S.C. 154(b) by 0 days.

(21) Appl. No.: 12/932,796

(22) Filed: Mar. 7, 2011

Related U.S. Application Data

(60) Provisional application No. 61/339,819, filed on Mar. 10, 2010.

(51) Int. Cl.
*A47G 29/12* (2006.01)

(52) U.S. Cl. ..... 232/39; 248/128

(58) Field of Classification Search ..... 232/39, 232/45, 17, 19, 29, 44, 43.5; 220/23.83; 248/128, 156
See application file for complete search history.

(56) References Cited

U.S. PATENT DOCUMENTS 3,021,996 A * 2/1962 Ranney ..... 232/39
(Continued)

*Primary Examiner* — William L. Miller
(74) *Attorney, Agent, or Firm* — Stone, Duncan & Linsenbach, PC

(57) ABSTRACT

This invention provides a roadside mailbox that is installed in a housing that can be wholly or partially buried in the ground. The open top of the housing is closed by a door that is attached to one of the end walls by a hinge, which allows it to be pivotally moved from a closed position where it closes the top of the housing to an open position where it is substantially vertical. The mailbox is so mounted as to be pivotally movable between a secure storage position where it is entirely within the housing and an operational position where it is in position for use. Pivotal movement of the door and the mailbox is accomplished by a mechanism driven by electric power from a battery positioned in the vault, and it is operated by an actuator that can be wireless or hard-wired. A solar panel installed on the door keeps the battery charged. The mailbox also can be laterally movable so that it extends outwardly beyond the door to facilitate depositing and retrieving mail.

20 Claims, 8 Drawing Sheets

U.S. PATENT DOCUMENTS

| | | | | |
|---|---|---|---|---|
| 3,593,914 | A * | 7/1971 | Van Orden | 232/47 |
| 4,114,801 | A * | 9/1978 | Van Orden | 232/17 |
| 5,632,441 | A * | 5/1997 | Toval | 232/17 |
| 5,954,264 | A * | 9/1999 | Keller | 232/17 |
| 6,533,167 | B2 * | 3/2003 | Hassan | 232/45 |
| 6,840,438 | B2 * | 1/2005 | Hassan | 232/54 |
| 6,957,767 | B2 * | 10/2005 | Aupperle et al. | 232/45 |
| 7,249,705 | B2 * | 7/2007 | Dudley | 232/47 |
| 7,854,374 | B2 * | 12/2010 | Dudley | 232/45 |
| 7,938,314 | B1 * | 5/2011 | Benesh | 232/45 |

* cited by examiner

SECURITY MAILBOX SYSTEM

RELATED PATENT APPLICATION

Support for the disclosure in this application is found in the applicant's Provisional Patent Application No. 61/339,819, filed Mar. 10, 2010.

BACKGROUND OF THE INVENTION

Mailboxes used in suburban and rural areas typically are mounted on fixed posts located adjacent to the roadway in position to receive mail deposited by a mail carrier. As such, they are vulnerable to damage from being struck by passing vehicles on the roadway, as well as by equipment such as the lawn mowers, snow moving machines, and other commonly used lawn and garden implements. The proximity of these mailboxes to the roadway also makes them easy targets for vandalism and theft of their contents.

It is an object of the present invention to provide a roadside mailbox which retracts into a stowed secure position between periods of use in order to overcome the above-mentioned problems. It is a further object of this invention to cause the mailbox and its supporting structure to be pivotally movable by remotely operated electrical means from the stowed secure position to an erected operational position at such times as the mailbox needs to be accessible to receive mail deposited by a mail carrier or to be retrieved by the user. A still further object of the invention is to accomplish the above movement by a mechanism that is simple in concept and operation, is relatively maintenance free, and is not prone to being affected by weather conditions. Another further object of this invention is to provide a mailbox that is laterally movable when in the erected position in the direction of the roadway, in order to make it more easily accessible by one who is depositing or retrieving mail from a vehicle.

THE PRIOR ART

As explained below, the present invention provides a security mailbox system in which the mailbox is pivotally movable between a substantially horizontal secure stowed position and a substantially vertical erected operating position in response to an electrically actuated drive mechanism. While the prior art includes mailboxes whose objectives are similar to those of the present invention, they accomplish these by the use of a different principles of operation and more complicated operating mechanisms. Examples of such prior art mailboxes are Ranney U.S. Pat. No. 3,021,996, Van Orden U.S. Pat. Nos. 3,593,914 and 4,114,801, and Toval U.S. Pat. No. 5,632,441.

SUMMARY OF THE INVENTION

This invention comprises a housing that can be buried in the ground, a door pivotally attached by hinges to one end of the housing, and a mailbox so mounted as to be pivotally movable along with the door between a substantially horizontal secure stowed position entirely within the housing and a substantially vertical erected operational position wherein the mailbox is in position to receive and dispense mail in the same manner as a conventional fixed mailbox. The movement of the mailbox and the door is accomplished by a drive mechanism that can be remotely operated by a wireless sending unit or by other signal sending means. A rechargeable battery, an electric motor, a receiving antenna, and a solar electric power generating panel to recharge the battery can be located within the housing. The mailbox also can be so mounted as to allow it to be moved laterally toward the roadway at an appropriate time in its operating cycle to facilitate the transfer and retrieval of the mail.

BRIEF DESCRIPTION OF THE DRAWINGS

For a more complete understanding of the invention, and to illustrate the objects and advantages of the invention, reference is made to the following description taken in conjunction with the accompanying drawings, in which.

DESCRIPTION OF PREFERRED EMBODIMENTS OF THE INVENTION

Figure 1:
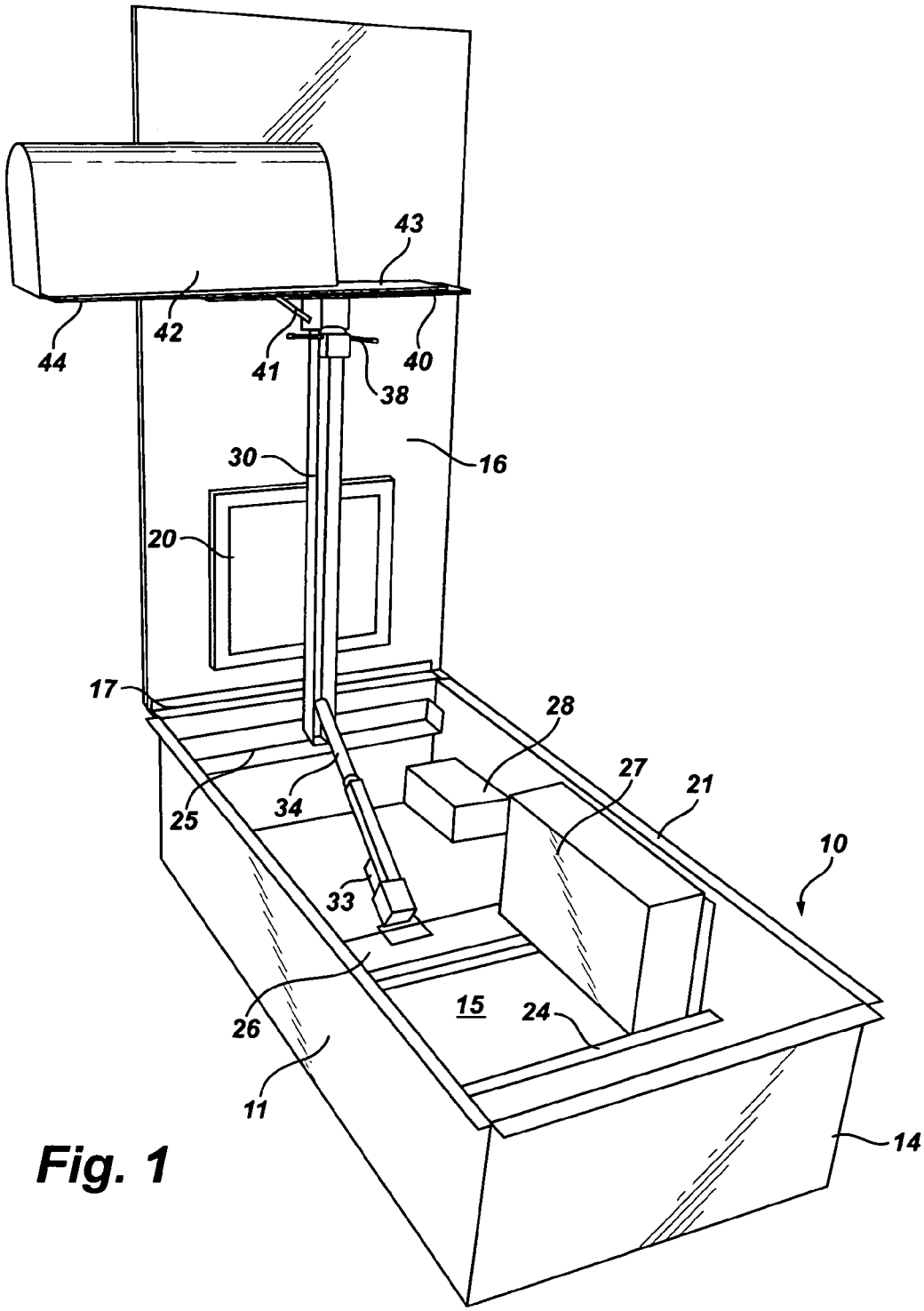
FIG. 1 is a perspective view of a first preferred embodiment of the invention with the mailbox and the operating components in the erected and laterally extended position, with details of some of the systems omitted for clarity.
Figure 2:
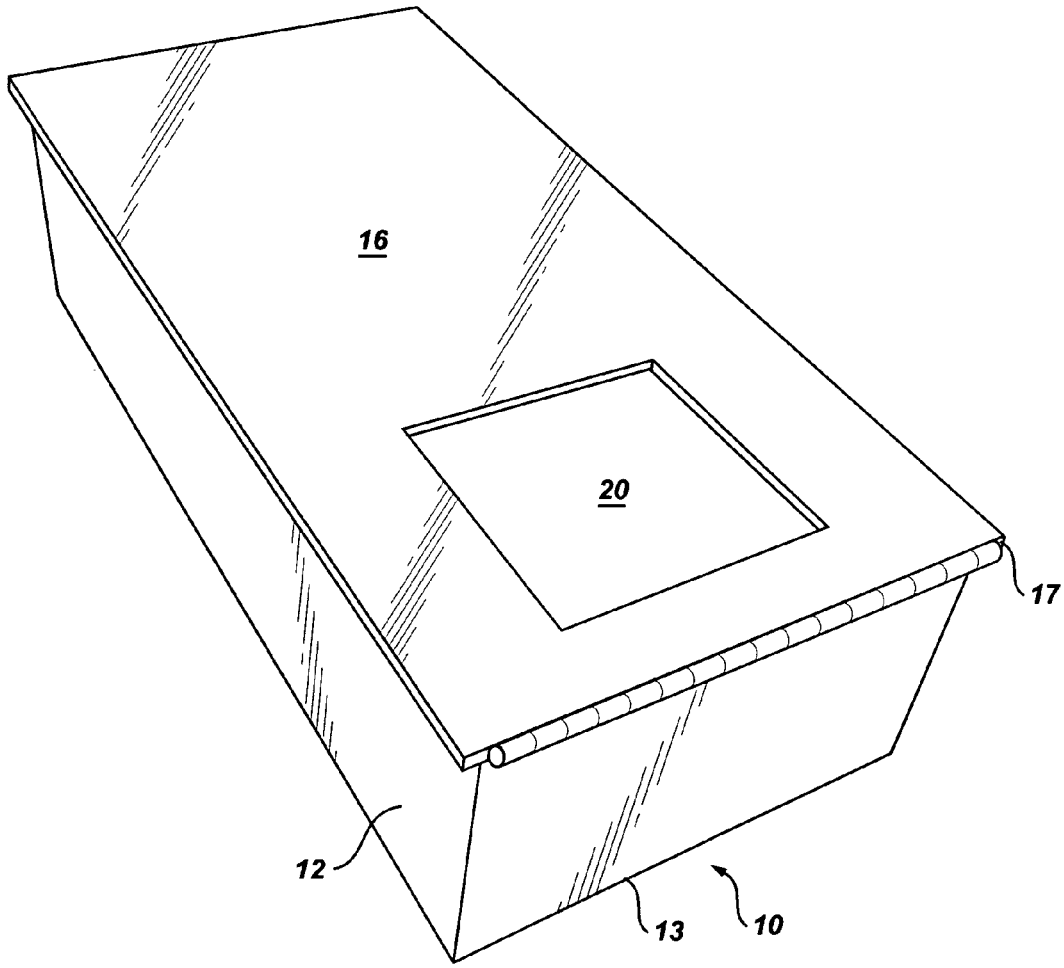
FIG. 2 is a perspective view of the embodiment of the invention shown in FIG. 1 with the mailbox and the operating components in the stowed position.
Figure 3:
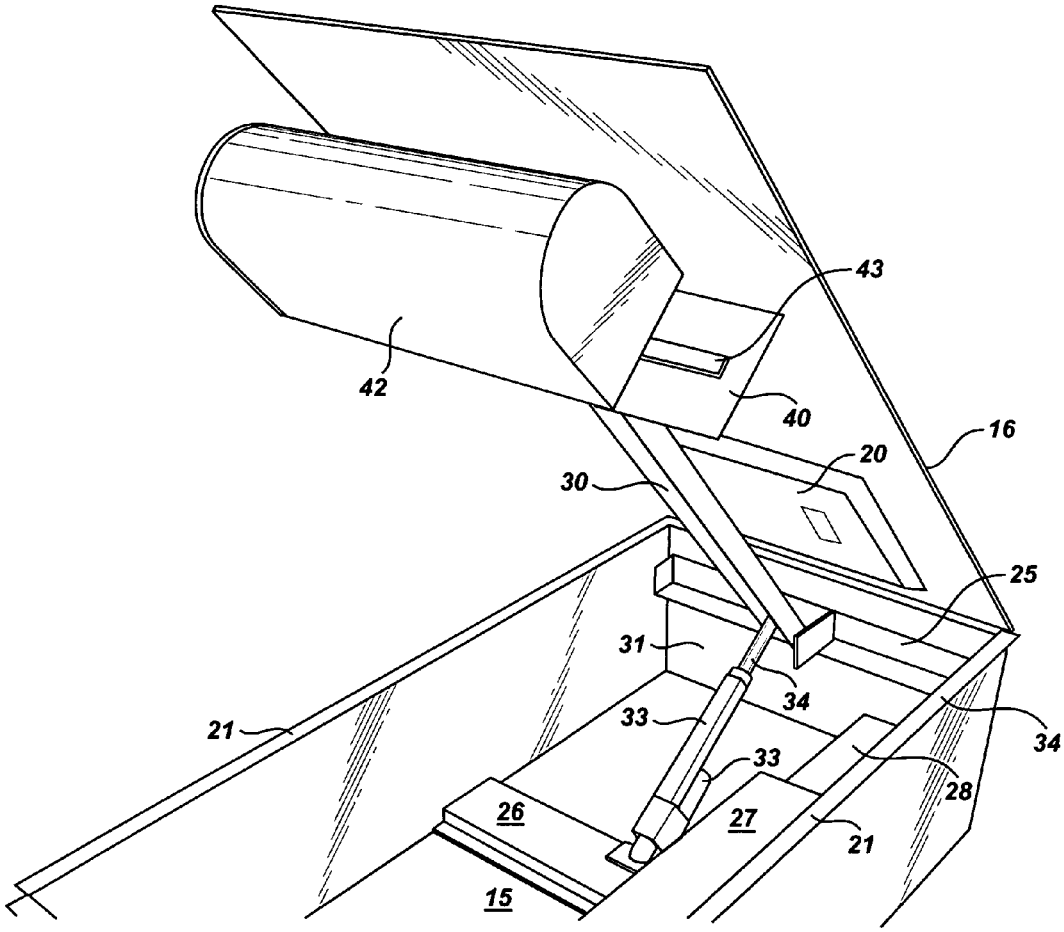
FIG. 3 is a perspective view of the embodiment of the invention shown in FIG. 1 with the mailbox and the operating components in an intermediate position between the stowed position and the erected position.

Looking first to FIGS. 1 through 3, a first preferred embodiment of the invention comprises a generally rectangular housing 10 defined by an elongated front panel 11, a corresponding elongated rear panel 12, a first end panel 13, a second end panel 14, and a bottom panel 15. A door 16 is attached to the upper edge of first end panel 13 by a piano type hinge 17, although other hinge designs can be used. Installed in door 16 is a solar electrical generating panel 20. While housing 10 has been shown as being rectangular in shape, other configurations are within the scope of the invention, so long as they can contain within them the mailbox and the operating components of the invention. The upper edges of panels 11, 12, 13 and 14 can be provided with outturned flanges 21 upon which are mounted sealing means to interact with the inner surface of door 16 to seal the interior of housing 10 from moisture and debris, and bottom panel 15 can be provided with openings to allow any moisture which may enter the interior of housing 10 to drain therefrom. Typical dimensions for the housing are a width of twenty-two inches, a length of forty-four inches, and a height of thirteen inches, although this may be varied within the scope of the invention.

Attached to the inside surfaces of front panel 11 and rear panel 12, and spanning the interior of housing 10, are a brace 24 and a pivot support member 25. Also spanning the interior of housing 10 is a motor support member 26. An electrical compartment 27 is positioned along the inside of rear panel 12, as is a rechargeable battery 28. Located within electrical compartment 27 are the electrical circuitry and components necessary to operate the mechanisms to be described hereafter, and to continuously charge battery 28 through the action of solar electrical generating panel 20. For clarity, electrical wires connecting the components have not been shown in the drawings.

Figure 4:
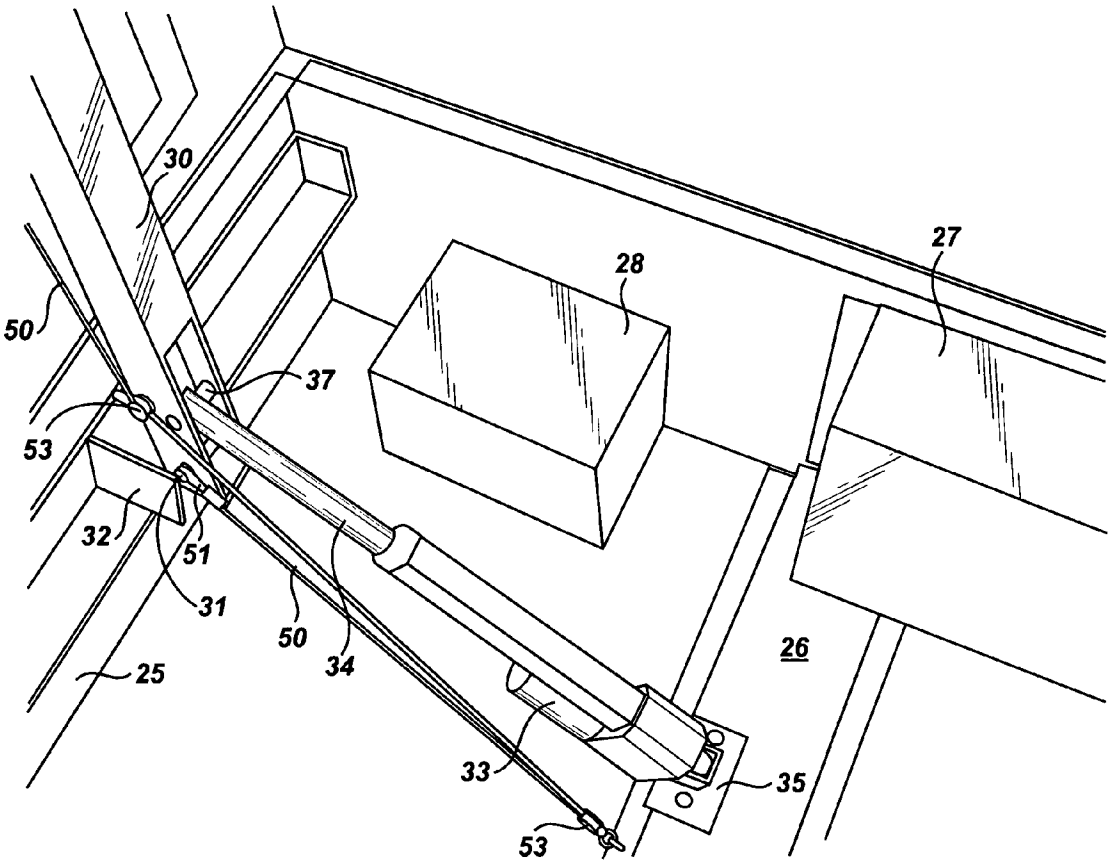
FIG. 4 is a detailed perspective view of the arrangement of mechanism that pivots the mailbox between the stowed position and the erected position in the embodiment of the invention shown in FIG. 1.
Figure 7:
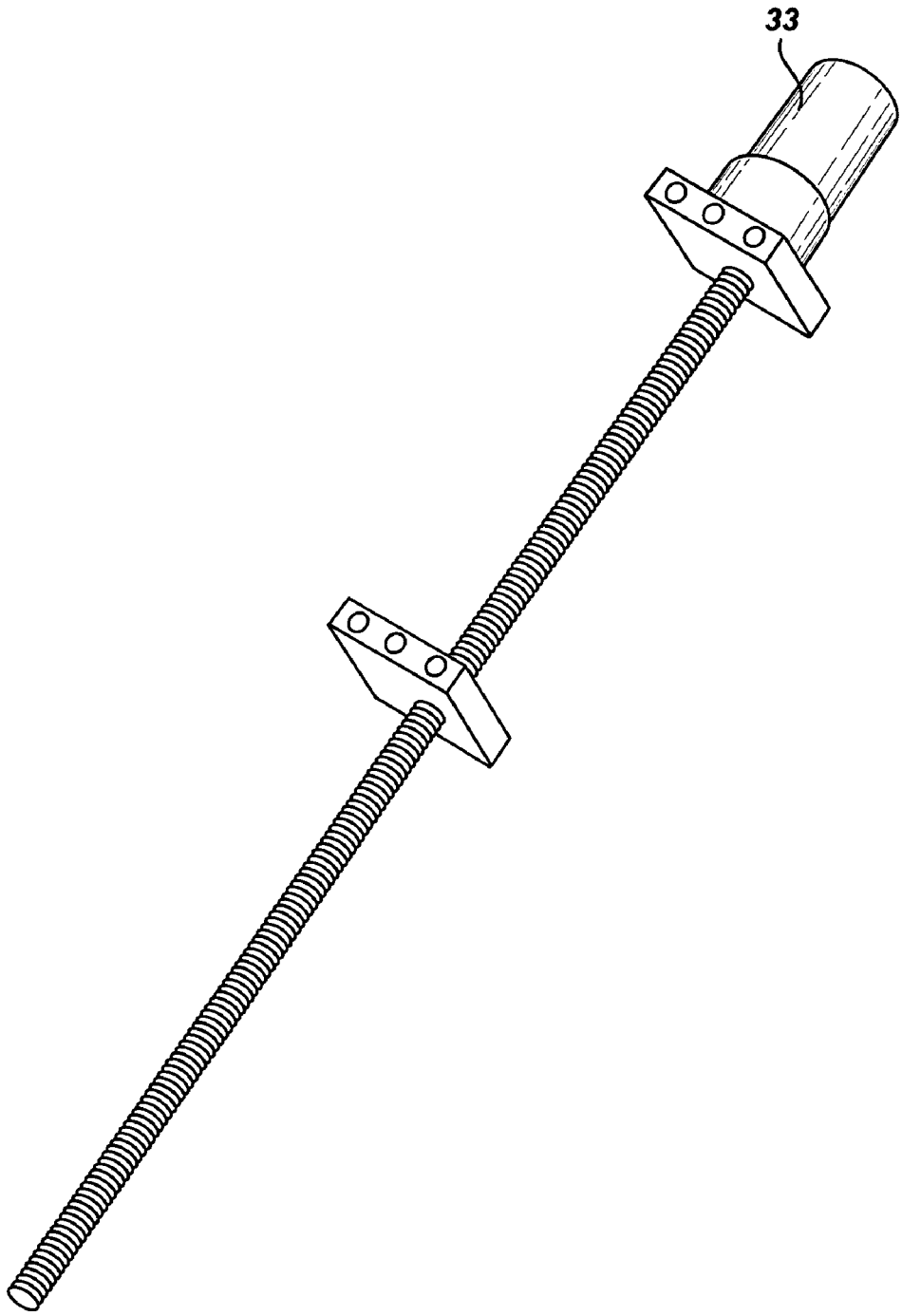
FIG. 7 is a perspective view of a drive motor and screw that is usable for moving the mailbox between the stowed and erected positions, as well as moving the mailbox laterally.

As shown best in FIG. 4, a mailbox post 30 is supported at its lower end for pivoting movement by a pivot pin 31 mounted on flanges 32, which in turn are attached to pivot support member 25. Mailbox post 30 is pivotally movable between a substantially horizontal stowed secure position essentially parallel to bottom panel 15 and a substantially vertical erected operational position. A motor 33 which motivates a longitudinally movable drive rod 34 is pivotally attached by means of a yoke 35 to motor support member 26. This can be an electrically operated screw drive system, such as is shown in FIG. 7, or can be other systems, electric or hydraulic. Motor 33 is operated by power supplied by battery 28, as controlled by electrical components located in electrical compartment 27. Alternatively, electrical power can be supplied by a hard wired connection to a remotely located battery or to house power. The distal end of drive rod 34 is pivotally attached by a pin 37 to the lower end of mailbox post 30 at a point spaced from pivot pin 35. Thus, when motor 33 is operated so as to extend or retract drive rod 34, mailbox post 30 is caused to pivot between its stowed position and its erected position. The limits of movement can be programmed by the electrical components within electrical compartment 27, or such can be accomplished by limit switches located externally thereof. When in the secure stowed position, mailbox post 30 and mailbox 42 are positioned beneath door 16 in that portion of housing 10 which is adjacent to open end panel 14.

An antenna 38 is mounted on mailbox post 30 or at any other suitable location where it can receive wireless signals, and is electrically connected to the components housed in electrical box 27. Antenna 38 receives wireless signals from a remote operating device, such as those used to operate garage doors or to open the doors of vehicles, in order to cause drive motor 33 to operate to move mailbox post 30 between its two positions. A manual operating switch can be provided inside housing 10 on electrical compartment 27, as can a manual operating switch or a keypad or the like on the outside of housing 10.

Mounted atop mailbox post 30 is a mailbox mounting platform 40. Mailbox 42 is of the conventional type, and can be fixedly mounted on platform 40. However, as shown in the drawings, mailbox 42 also can be provided with a means for causing it to move laterally outwardly on platform 40, toward the roadway along which the inventive device is installed, which offers the advantage of allowing mail to more easily by placed into and retrieved from mailbox 42. In this regard, a track 43 is attached to the upper surface of mounting plate 40, and this interacts with a complementary track (not shown), which is attached to the bottom surface of a mailbox support plate 44 that is affixed to the underside of mailbox 42 and movable therewith. This enables mailbox 42 to slide laterally back and forth with respect to fixed platform 40 while being retained thereon. Other manners of interlocking mailbox 42 with fixed platform 40 while permitting this lateral movement of mailbox 42 are within the scope of this invention.

Lateral movement of mailbox 42 to a point that is beyond the plane of front panel 11 of housing 10 can be provided by means of a cable 50 that is secured at its lower end to an anchor 51, mounted on the lower end of post 30. At its upper end cable 50 is secured to an angled cable bracket 52 that is attached to mailbox 42 and extends downwardly and under post platform 40. The path of cable 50 between anchor 51 and bracket 52 is a circuitous one defined by several pulleys 53. The length of cable 50 and the placement and orientation of pulleys 53 are such that cable 50 is relaxed when mailbox post 30 and mailbox 42 are in the stowed position, but when mailbox post 30 and mailbox 42 are moved toward the erected position cable 50 is caused to be placed under tension by the relative movement of the various components, resulting in mailbox 42 being pulled progressively laterally and outwardly with respect to the fixed mounting plate 40. The arrangement of pulleys 53 and the length of cable 50 are related in such a manner as not to move mailbox 42 laterally outwardly beyond the plane of front panel 11 of housing 10 until it is clear of the upper edge of front panel 11. Lateral movement of mailbox 42 is resisted by a coil spring 54, one end of which engages a spring bracket 55 that is hooked onto the edge of fixed platform 40, and the other end of which is attached beneath mailbox 42 to mailbox plate 44. Spring 54 is stretched as cable 50 pulls mailbox 42 laterally as it is raised from the stowed position to the erected position. When movement is reversed, that is, mailbox 42 is moved by drive motor 33 from the erected position to the stowed position, spring 54 pulls it laterally back within the plane of front panel 11. This also maintains tension on cable 50 as the mechanism returns to the stowed position. Suitable means for adjusting the length of cable 50 can be provided. If lateral movement of mailbox 42 is not desired, cable 50 and its accessories are not provided, nor is spring 54, and mailbox 42 is attached directly to fixed post platform 40. Mailbox 42 alternatively can be caused to move laterally by the use of a second drive motor 33 (FIG. 7), which can be positioned on fixed post platform 40 in such a manner as to engage rack 45. In such case the cable system is deleted and suitable electrical controls are provided to operate the screw motor in an appropriate fashion.

Figure 5:
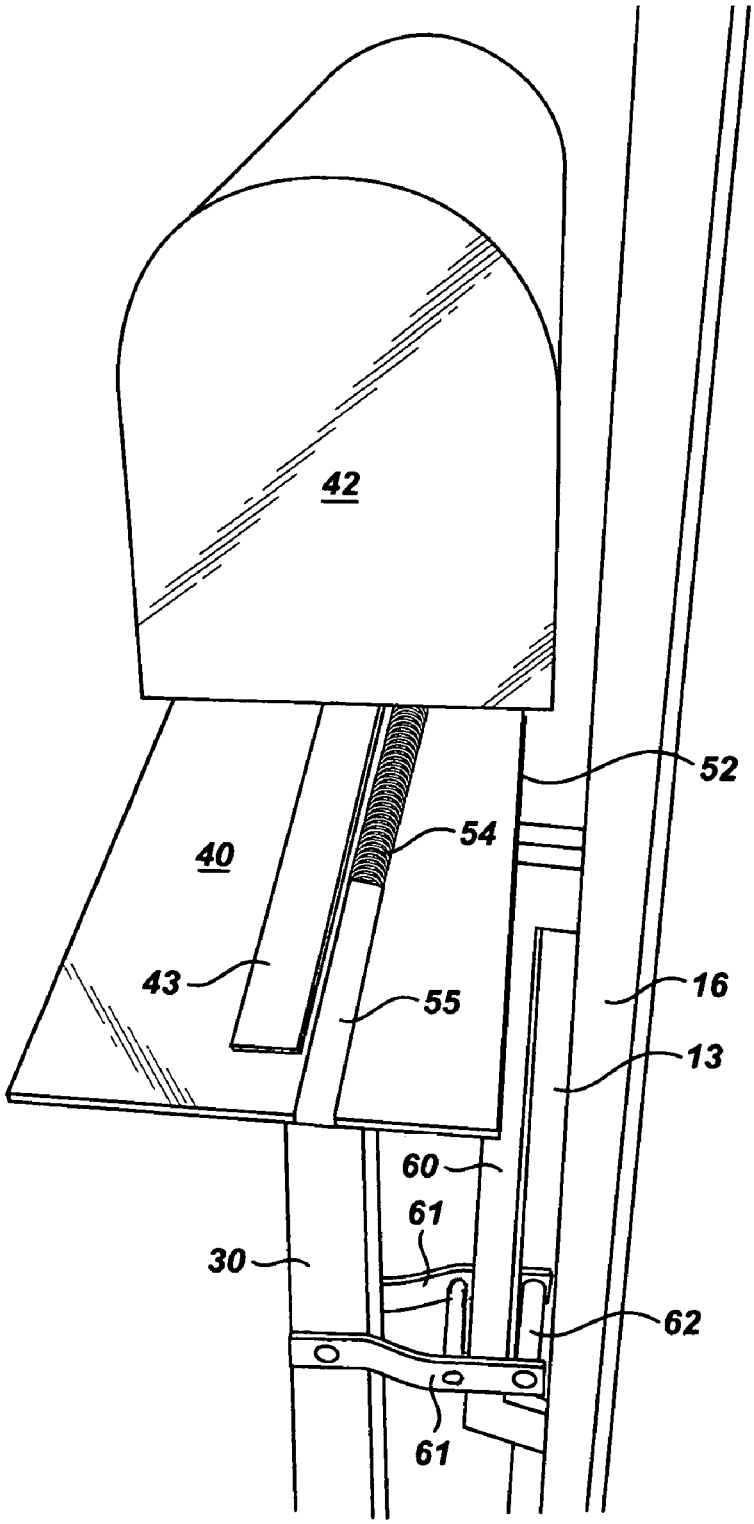
FIG. 5 is a detailed perspective view of the mailbox and the structure upon which it is laterally movable in the embodiment of the invention shown in FIG. 1.
Figure 6:
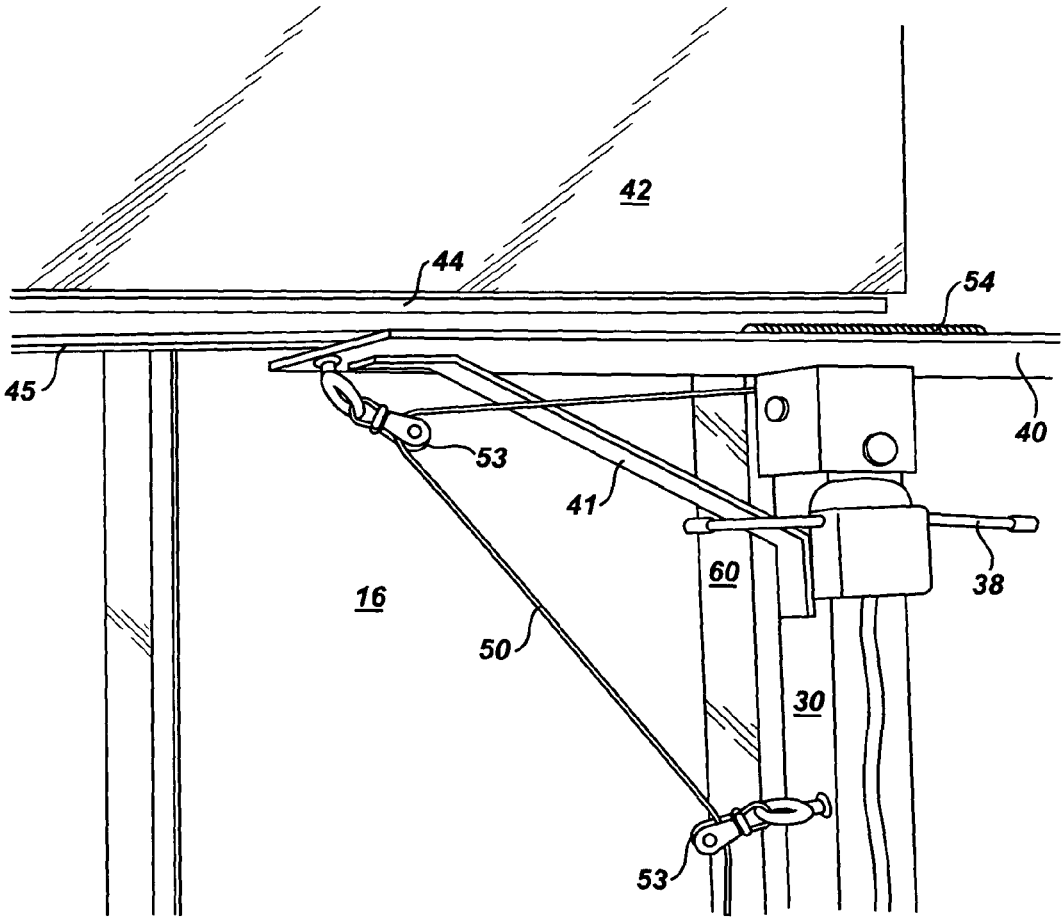
FIG. 6 is another detailed perspective view of the mailbox and the structure upon which it is laterally movable in the embodiment of the invention shown in FIG. 1.

To insure the proper operation of the first embodiment of the invention, post 30 and door 16 must be moved in a coordinated fashion. Door 16 and post 30 in this embodiment of the invention rotate about parallel but spaced axes at their separate points of pivotal attachment (hinge 17 and pivot pin 31, respectively). This means that mailbox post platform 40, and mailbox 42 which is carried thereon, move with respect to door 16 as they pivot between the stowed position and the erected position. The relative movement of these components requires that they be spaced from one another, however, they also must be connected together to maintain this spacing and so that they pivot in a coordinated fashion. To accomplish this, a lost motion connection is provided, which comprises an elongated channel member 60 attached to but spaced from the inside surface of door 16 and a pair of yoke members 61 attached to mailbox post 30. Yoke members 61 support a pair of followers 62 that move engage the opposite sides of channel member 60, as is shown in FIG. 5. This arrangement maintains the spacing between door 16 and platform 40 while allowing these two components to move with respect to one another as they are being pivoted between the stowed position and the erected position. The arrangement also insures that lateral movement of mailbox 42 is unimpeded.

Figure 8:
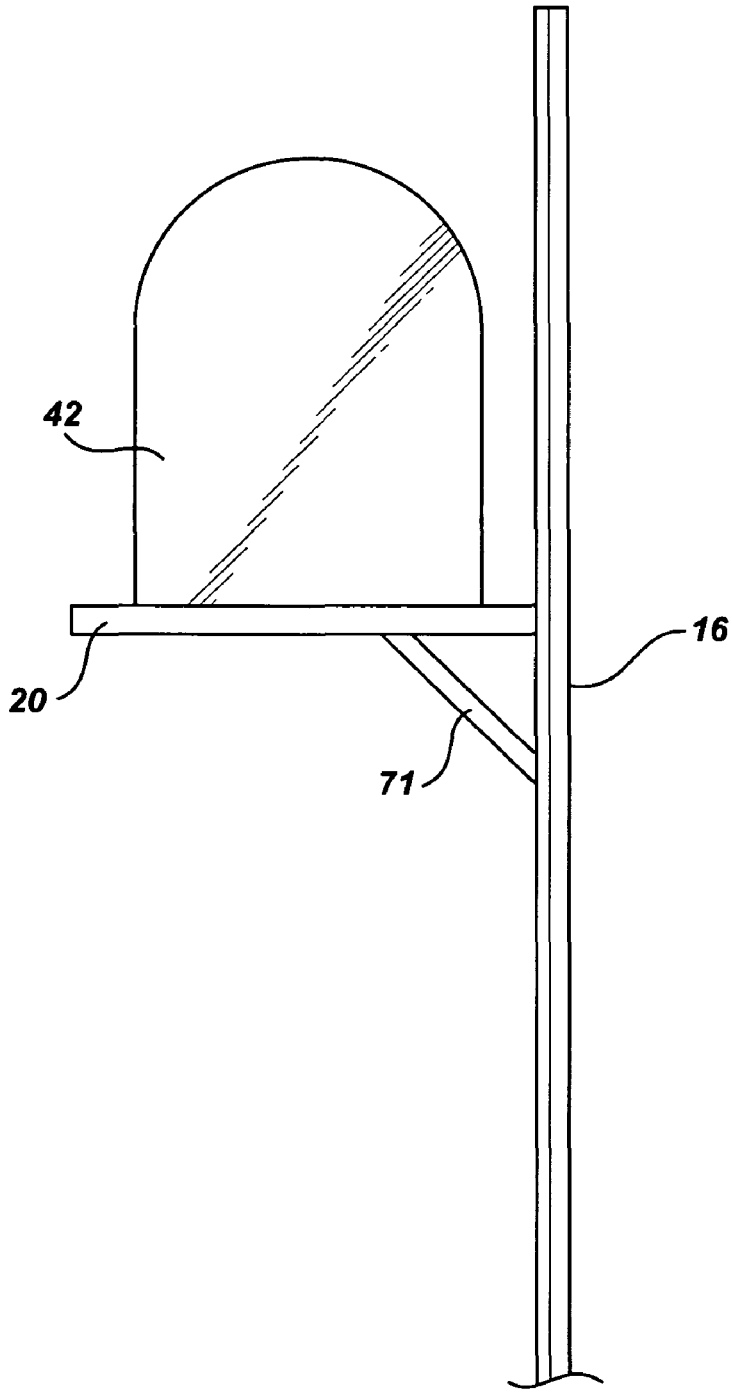
FIG. 8 is a side elevations view of a second preferred embodiment of the invention in which the mailbox is mounted directly upon the door.

In the second preferred embodiment of the invention shown in FIG. 8, mailbox 42 is mounted directly to the inside surface of door 16. If lateral movement is not desired, mailbox 42 can be attached directly to door 16. If the lateral movement feature is provided, a mailbox platform 65 can be attached directly to the inside surface of door 16, with mailbox 42 slidably mounted thereon, in the same manner as was described above with regard to the other preferred embodiment of the invention. Also, as was the case in the other embodiment, lateral movement of mailbox 42 will be coordinated with the pivotal movement of door 16. In this embodiment the distal end of drive rod 34 is pivotally attached directly to the inside surface of door 16, and lateral movement of mailbox 42 can be accomplished by means of a cable or a separate electric motor, both operating in the manner explained above with regard to the first embodiment of the invention.

In the operation of either of the above-described embodiments of the invention, housing 10 can be wholly or partially buried in the ground. Several modes of operation are contemplated. For example, door 16 and mailbox 42 can be caused to pivot between the secured stowed position and the operational erected position when desired by the user by causing the motor to operate by signals from wireless or hard-wired control means. Alternatively, the mechanism can be operated automatically by a timer which signals the mechanism to erect the mailbox at the time a mail delivery is expected, and then retract it later at a set time, a sequence that can be repeated when the mail is expected to be retrieved by the user. Another alternative is manual operation by a touchpad or other switch means located on or adjacent to the vault.

While preferred embodiments of the invention have been shown and described herein, it should be understood that these are by way of example only, and that variations and changes are possible within the scope of the following claims.

The invention claimed is:

1. A security mailbox system comprising:

a housing having a bottom, sides extending from said bottom and terminating in upper edges being in a substantially flat plane, and a substantially open top;

a door pivotally mounted on said housing and pivotally movable about an axis parallel to said plane between a first position closing said substantially open top and a second position at an angle to said plane;

a mailbox mounted in said housing and movable between a secure stowed position wherein said mailbox is within said housing when said door is in said first position and an erected operational position when said door is in said second position;

drive means mounted in said housing, said drive means pivotally moving said door between said first position and said second position and pivotally moving said mailbox between said secure stowed position and said operational position; and control means communicating with said drive means for selectively activating said drive means.

2. The security mailbox system of claim 1 wherein said drive means comprises a drive motor mounted in said housing and a drive rod driven by said drive motor and attached to said door at a point spaced from said axis, whereby said drive rod causes said door to pivot between said first position and said second position.

3. The security mailbox of claim 2 wherein said drive motor is electric and said control means comprises a wireless sending device, an antenna for receiving wireless signals from said wireless sending device, electronic circuitry for causing said drive motor to operate in response to said wireless sending device, and a battery for providing electric power to said drive motor and said electronic circuitry.

4. The security mailbox of claim 3 further comprising a solar panel electrically connected to said battery for maintaining an electric charge on said battery.

5. The security mailbox system of claim 1 wherein said door comprises an inside surface defined by a front side edge and a rear side edge and said mailbox is connected to said inside surface between said front side edge and said rear side edge, whereby said drive means coincidentally moves said door between said first position and said second position and said mailbox between said secure stowed position and said erected operation position in response to said control means.

6. The security mailbox system of claim 5 wherein said mailbox mounting means comprises a fixed mailbox mounting plate connected to said inside surface of said door between said front side edge and said rear side edge, a movable mailbox mounting plate fixedly attached to said mailbox, slide means interconnecting said fixed mailbox mounting plate and said movable mailbox mounting plate for movement laterally of said inside surface of said door between a retracted position wherein said mailbox is positioned between said front side edge and said rear side edge and an extended position wherein said mailbox extends beyond said front side edge, and a mailbox lateral drive means for moving said mailbox along said slide means between said retracted position and said extended position.

7. The security mailbox system of claim 6 wherein said mailbox lateral drive means comprises a cable attached at one end to said housing and at the other end to said mailbox, said cable moving said mailbox from said retracted position to said extended position when said mailbox is in said operational position.

8. The security mailbox system of claim 6 wherein said mailbox lateral drive means comprises a mailbox drive motor and a mailbox drive control system for moving said mailbox from said retracted position to said extended position when said mailbox is in said operational position.

9. A security mailbox system comprising:

a housing having a bottom, sides extending from said bottom and terminating in upper edges being in a substantially flat plane, and a substantially open top;

a door having a front side edge and a rear side edge, said door being pivotally mounted on said housing and pivotally movable about a door axis parallel to said plane between a first position closing said substantially open top of said housing and a second position at an angle to said plane;

a mailbox post having a proximal end and a distal end, said proximal end being pivotally mounted in said housing;

a mailbox mounted on said distal end of said mailbox post, said mailbox post and said mailbox being pivotally movable about a post axis parallel to said plane between a secure stowed position wherein said mailbox is within said housing when said door is in said first position and an erected operational position at an angle to said plane when said door is in said second position, said mailbox post and said mailbox being spaced from said door;

drive means mounted in said housing, said drive means pivotally moving said mailbox post and said mailbox between said secure stowed position and said erected operational position;

door linkage means connecting said door and said mailbox post whereby when said mailbox post is moved between said secure stowed position and said erected operational position by said drive means said door also coincidentally is moved between said first position and said second position by said drive means; and control means communicating with said drive means for selectively activating said drive means to move said mailbox post and said mailbox between said secure stowed position and said erected operational position and said door between said first position and said second position.

10. The security mailbox system of claim 9 wherein said drive means comprises a drive motor and a drive rod driven by said drive motor, said drive rod being pivotally attached to said mailbox post at a rod axis which is spaced along said mailbox post from said post axis whereby said drive rod causes said mailbox post to pivot between said secure stowed position and said operational position and said door to pivot between said first position and said second position.

11. The security mailbox system of claim 10 further comprising:

a storage battery electrically connected to and powering said drive motor and said control means.

12. The security mailbox system of claim 10 further comprising:

a solar electric power generating panel electrically connected to said battery for charging said battery.

13. The security mailbox system of claim 9 wherein said door linkage means comprises a spacer member attached to one of said mailbox post and said door and defining an elongated space, and a follower member attached to the other of said mailbox post and said door and extending into said elongated space, whereby said mailbox post and said door move longitudinally relative to one another as said mailbox post is moving between said secure stowed position and said erected operational position and said door is moving between said first position and said second position.

14. The security mailbox system of claim 9 further comprising:

a fixed mailbox mounting plate on said distal end of said mailbox post;

a movable mailbox mounting plate fixedly attached to said mailbox;

slide means interconnecting said fixed mailbox mounting plate and said movable mailbox mounting plate for movement of said mailbox laterally of said door between a retracted position wherein said mailbox is positioned between said front side edge of said door and said rear side edge of said door, and an extended position wherein said mailbox extends beyond said front side edge of said door; and mailbox drive means for moving said mailbox laterally along said slide means between said retracted position and said extended position.

15. The security mailbox system of claim 14 further comprising:

a spring biasing said movable mailbox mounting plate toward said retracted position;

wherein said mailbox drive means comprises a cable attached at one end to said housing and at the other end to said mailbox and traversing a path such that said cable is in a relaxed state when said mailbox post and said mailbox are in said secure stowed position and said mailbox is in said retracted position and increases in tension as said mailbox post and said mailbox move toward said operational position, thereby causing said mailbox to move from said retracted position to said extended position against the bias of said spring; and wherein said increase in tension is such that said mailbox does not contact said housing during movement between said secure stowed position and said operational position.

16. The security mailbox system of claim 14 wherein said mailbox drive means comprises a motor and a motor control system.

17. The security mailbox system of claim 9 further comprising:

an antenna for receiving wireless control signals, said antenna being in electrical communication with said control means; and a wireless transmitter for sending control signals to be received by said antenna to cause said control means to operate said drive means.

18. A security mailbox system comprising:

a substantially rectangular housing having a bottom panel, a front side panel, a rear side panel, an open end side panel and a hinge end side panel, each of said side panels extending from said bottom panel and terminating in an upper edge with all said upper edges being in a substantially flat plane and defining a substantially open housing top;

a door having a front side edge, a rear side edge, an open side edge, a pivot side edge, an inner surface and an outer surface, said door being mounted on said housing hinge end side panel by a door hinge and being pivotally movable thereon about a door hinge axis parallel to said substantially flat plane between a first door position closing said substantially open top of said housing and a second door position at an angle to said substantially flat plane;

a mailbox post having a proximal end pivotally mounted in said housing and a distal end having a fixed mailbox mounting plate attached thereto;

a mailbox attached to said mailbox mounting plate, said mailbox, post and said mailbox being pivotally movable about a mailbox post axis parallel to said substantially flat plane between a secure stowed position wherein said mailbox is within said housing when said door is in said first position and an erected operational position at an angle to said substantially flat plane when said door is in said second position, said mailbox post and said mailbox being spaced from said door, drive means mounted in said housing, said drive means pivotally moving said mailbox post and said mailbox between said secure stowed position and said erected operational position, said drive means comprising a drive motor and a drive rod driven by said drive motor, said drive rod being pivotally attached to said mailbox post at a rod axis which is spaced along said mailbox post from said mailbox post axis, whereby said drive rod causes said mailbox post to pivot between said secure stowed position and said operational position and said door to pivot between said first position and said second position;

door linkage means connecting said door and said mailbox post, said door linkage means comprising a spacer member attached to one of said mailbox post and said door and defining an elongated space and a follower member attached to the other of said mailbox post and said door and extending into said elongated space, whereby said mailbox post and said door move longitudinally relative to one another as said mailbox post is moving between said secure stowed position and said erected operational position and said door is moving between said first position and said second position;

control means communicating with said drive means for selectively activating said drive means to move said mailbox post and said mailbox between said secure stowed position and said erected operational position and said door between said first position and said second position;

a storage battery electrically connected to and powering said drive motor and said control means;

a solar electric power generating panel electrically connected to said battery for charging said battery;

an antenna for receiving wireless control signals, said antenna being in electrical communication with said control means; and a wireless transmitter for sending control signals to be received by said antenna to cause said control means to operate said motor.

19. The security mailbox of claim 18 further comprising:

a movable mailbox mounting plate fixedly attached to said mailbox;

slide means interconnecting said fixed mailbox mounting plate and said movable mailbox mounting plate for movement of said mailbox laterally of said door between a retracted position wherein said mailbox is positioned between said front side edge of said door and said rear side edge of said door, and an extended position wherein said mailbox extends beyond said front side edge of said door; and a spring biasing said movable mailbox mounting plate toward said retracted position;

wherein said mailbox drive means comprises a cable attached at one end to said housing and at the other end to said mailbox and traversing a path such that said cable is in a relaxed state when said mailbox post and said mailbox are in said secure stowed position and said mailbox is in said retracted position and increases in tension as said mailbox post and said mailbox move toward said operational position, thereby causing said mailbox to move from said retracted position to said extended position against the bias of said spring; and wherein said increase in tension is such that said mailbox does not contact said housing during movement between said secure stowed position and said operational position.

20. The security mailbox of claim 18 further comprising:

a movable mailbox mounting plate fixedly attached to said mailbox;

slide means interconnecting said fixed mailbox mounting plate and said movable mailbox mounting plate for movement of said mailbox laterally of said door between a retracted position wherein said mailbox is positioned between said front side edge of said door and said rear side edge of said door, and an extended position wherein said mailbox extends beyond said front side edge of said door; and wherein said mailbox drive means comprises a mailbox motor and a mailbox motor control system.

* * * * *